US006351059B1

(12) United States Patent
Takemura

(10) Patent No.: US 6,351,059 B1
(45) Date of Patent: Feb. 26, 2002

(54) FIELD-EMISSION TYPE COLD CATHODE AND APPLICATION THEREOF

(75) Inventor: Hisashi Takemura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/399,518

(22) Filed: Sep. 20, 1999

(30) Foreign Application Priority Data

Sep. 21, 1998 (JP) ..... 10-266950

(51) Int. Cl.[7] ..... H01J 1/02

(52) U.S. Cl. ..... 313/309; 313/495; 313/336; 313/351

(58) Field of Search ..... 313/495, 309, 313/336, 351

(56) References Cited

FOREIGN PATENT DOCUMENTS

| | | |
|---|---|---|
| JP | 7-85778 | 3/1995 |
| JP | 10-12128 | 1/1998 |
| JP | 10-5021 | 2/1998 |
| JP | 10-50205 | 2/1998 |

*Primary Examiner*—Vip Patel
(74) *Attorney, Agent, or Firm*—Hutchins, Wheeler & Dittmar

(57) ABSTRACT

A field-emission type cold cathode is disclosed, by which the degradation of the withstand voltage between the gate electrode and emitter and discharge destruction are suppressed, and the operating voltage and the distance between the gate electrode and emitter can be reduced. The cold cathode comprises a substrate (on a surface of which an emitter is formed) for functioning as a leading emitter electrode; and a gate electrode, formed via an insulating film on the substrate, having an aperture which surrounds the emitter via a space. The height of a boundary (which faces the space) between the insulating film and the substrate is lower than the height of the surface of the substrate on which the emitter is formed. An insulated trench surrounds the area on which the emitter is formed, where the above boundary is placed between the emitter and the trench, and a part of the insulating film is present between the boundary and the trench.

9 Claims, 7 Drawing Sheets

FIELD-EMISSION TYPE COLD CATHODE AND APPLICATION THEREOF

BACKGROUND OF THE INVENTION

1. Field of the Invention

The present invention relates to a field-emission type cold cathode, and in particular, to one having a gate electrode in the vicinity of the emitter which emits electrons. The present invention also relates to applications of such a field-emission type cold cathode.

This application is based on Patent Application No. Hei 10-266950 filed in Japan, the contents of which are incorporated herein by reference.

2. Description of the Related Art

The field-emission type cold cathode is a device comprising a sharp conical emitter and a gate electrode which is formed in the vicinity of the emitter and has a sub-micron-order aperture. In such a device, a high field is concentrated at the pointed end of the emitter, from which electrons are emitted in a vacuum. The emitted electrons are received by an anode electrode which is separately formed. Recently, such devices have become smaller based on the development of the fine manufacturing techniques, and such smaller devices are widely used as constituents of subminiature triode electron tubes or electron guns used in thin display devices.

In conventional field-emission type cold cathodes having a gate diameter of approximately 1 $\mu$m, a voltage of approximately 100 V is applied between the emitter and the gate electrode so as to emit electrons from the head point of the emitter. However, with an operating voltage of 100 V or more, the operating conditions are limited with respect to the power consumption, control circuits, or the like; thus, operation with a lower voltage has been required. An example method for satisfying such a requirement is to provide gate electrode with a fine aperture (i.e., with a very small diameter). However, making a fine aperture is accompanied with having a thinner thickness of the insulating film between the emitter and gate electrode, thereby degrading the withstand voltage. Therefore, a method for making a gate electrode of a fine diameter without degrading the withstand voltage has been required.

In addition, the emitter and the gate electrode are separately but closely arranged, so that a discharge may occur between the emitter and the gate electrode. If such a discharge produces an excess current flowing through the emitter or the gate electrode, the material of the electrode may melt and short-circuit breakdown may occur between the emitter and gate electrode.

In order to prevent such a failure, that is, to suppress an excess current due to the discharge, it is effective to provide another element for suppressing current, at the emitter or gate electrode. A typical known method is to form a resistor connected to the emitter. However, in this method, an area for forming a resistor is necessary, and the current-suppressing effect is also effective during the normal operation so that the operating voltage may rise. In these circumstances, a vertically-formed current control element having non-linear current/voltage characteristics has peen proposed.

Japanese Unexamined Application, First Publication, No. Hei 10-12128 discloses an example of a field-emission type cold cathode comprising such a vertically-formed current control element.

FIGS. 8A to 8F are sectional views for explaining the manufacturing processes in the first conventional example performed in turn.

As shown in FIG. 8A, masking film 14 consisting of an oxide film is formed on silicon substrate 1 at a thickness of 1 $\mu$m, and then the patterning of masking film 14 is performed using a resist or the like, so that the substrate 1 is exposed. The anisotropic etching using the masking film 14 as a mask (for the etching) is performed on the exposed substrate so that trench 4 of 10 $\mu$m depth is formed.

Next, a BPSG (boron-phosphorus silicate glass) film of 2 $\mu$m thickness is formed using the LPCVD (low pressure chemical vapor deposition) method, and the etchback process is performed until the BPSG film 5 is embedded within the trench 4, as shown in FIG. 8B.

Next, as shown in FIG. 8C, oxide film 6 is deposited at a thickness of approximately 400 nm by using the CVD method, and gate electrode film 7 is further deposited at a thickness of 200 nm by using a spattering method, so as to perform the patterning of the electrode having a desired shape.

Then, as shown in FIG. 8D, gate aperture 8 having an approximately 0.5 $\mu$m diameter is formed in an area where an emitter is provided later, by selectively etching the gate electrode 7 and oxide film 6, and a sacrificial layer 9 such as an alumina film is deposited on the top face of the gate electrode 7 and on the side walls of the gate electrode 7 and oxide film 6 by performing the rotational vapour deposition from a slantwise direction. An emitter material such as molybdenum is then deposited from a vertical direction by the vapour deposition, so that emitter 10*a* and extra emitter material 10*b* are respectively formed on the substrate and the sacrificial layer.

Lastly, as shown in FIG. 8F, the sacrificial layer is etched using phosphoric acid or the like, so that the emitter material 10*b* is lifted off and a field-emission type cold cathode is obtained.

In the above conventional example, the portion surrounded by trench 4 functions as a discharge-current suppressing element having non-linear current/voltage characteristics, thereby preventing a short-circuit breakdown of the device.

FIG. 9 shows an example of a structure for further improving the operational characteristics. In this structure, a set of oxide film 6 and gate electrode 7, having an aperture, is deposited on silicon substrate 1. A sharp conical emitter 10*a* is formed in the gate aperture 8, and the area of emitter 10*a* is surrounded by trench 4 (in substrate 1) in which BPSG film 5 is embedded. In addition, an n type area, more specifically, n type diffusion layer 12 (to which n type impurity is doped with a higher concentration than that of substrate 1) is provided in the top face of the substrate 1.

That is, in this example, the n type diffusion layer 12 is added to the structure shown in FIG. 8F. The structure shown in FIG. 9 can reduce the contact resistance at the lower part of the emitter and prevent the current (path) from concentrating at the lower part of the emitter. That is, without the n type diffusion layer 12, current concentrates at a local area when a discharge occurs, so that a voltage is applied to a local area due to the contact resistance between the emitter and the substrate, which causes a breakdown and reduces the effective length of the discharge-current suppressing element (provided in the area surrounded by the trench and having non-linear current/voltage characteristics). That is, the structure shown in FIG. 9 prevents a high field from applying to both sides of the element having a shorter effective length; thus, degradation of the withstand voltage can be prevented.

The first problem related to the conventional technique is that a thermal (i.e., thermally oxidized) oxide film having better insulating capability cannot be used for forming the insulating film below the gate electrode, so that the finer the gate diameter, the thinner the insulating film is, thereby reducing the withstanding voltage between the emitter and gate electrode. This is because the height of the emitter is in proportion to the diameter of the gate aperture. For example, if the diameter of the gate aperture decreases from 0.8 $\mu$m to 0.4 $\mu$m, then the thickness of the oxide film also decreases from 0.4 $\mu$m to 0.2 $\mu$m.

The second problem related to the conventional technique is that when the oxide film between the emitter and gate electrode (being accompanied with a finer gate diameter) becomes thinner, the creeping distance along the side wall of the oxide film becomes shorter. Generally, a surface of the oxide film, exposed in a vacuum, between the emitter and gate electrode may include a path relating to the generation of surface states, accretion, discharge on the relevant surface, or the like, that is, such a path may generate a leak current between the emitter and gate electrode. Accordingly, if the oxide film between the emitter and gate electrode is made thinner according to a finer structure and the creeping distance is made shorter, then a leak current flows between the emitter and gate electrode.

The third problem related to the conventional technique is that the withstand voltage of the discharge-current suppressing element, formed via the trench, is reduced along with the employment of a thinner oxide film between the emitter and gate electrode according to a finer structure of the device. This is because the withstand voltage with respect to the cross direction is reduced or degraded. Here, the withstand voltage in the longitudinal direction depends on the depth of the trench, while the withstand voltage in the cross direction depends on the width of the trench. These withstand voltages determine the withstand voltage of the field-emission type cold cathode.

Practically, the withstand voltage in the cross direction also depends on the width of the trench and the potential difference generated between the emitter and the trench. When the gate electrode is positively voltage-applied and the oxide film below this gate electrode is thinner, an n type channel is formed in the substrate below the oxide film and in the substrate; thus, the withstand voltage only depends on the width of the trench in this case. This dependence condition may be remarkable in a structure having an n type diffusion layer 12 on the substrate as shown in FIG. 9 so as to reduce the contact resistance between the emitter and the substrate.

SUMMARY OF THE INVENTION

Therefore, an objective of the present invention is to solve the above problems such as degradation of the withstand voltage and increase of the leak current between the emitter and gate electrode, and degradation of the withstand voltage when a discharge occurs, these phenomena usually accompanying a finer structure. A further objective of the present invention is to reduce the distance between the gate electrode and emitter, apply a higher electric field to the head point of the emitter, decrease the operational voltage, and simultaneously improve the reliability.

Therefore, the present invention provides a field-emission type cold cathode comprising:

a substrate, on a surface of which an emitter for emitting electrons is formed, for functioning as a leading (or lead) emitter electrode;

a gate electrode, formed via an insulating film on the substrate, having an aperture which surrounds the emitter via a space, and wherein the height of a boundary, facing the space, between the insulating film and the substrate is lower than the height of the surface of the substrate on which the emitter is formed, and the cold cathode further comprising:

an insulated trench surrounding an area on which the emitter is formed, where the boundary between the insulating film and the substrate is placed between the emitter and the trench, and a part of the insulating film is present between the boundary and the trench.

Accordingly, the field-emission type cold cathode of the present invention can operate with a low operating voltage and has a high withstand voltage, by which excess current generated when a discharge occurs can be suppressed while maintaining a suitable voltage during the normal operation.

This is because sufficient space exists between the emitter and gate electrode, and the thickness of the insulating film for supporting the gate electrode can be greater than the distance between the emitter and gate electrode. Therefore, even if the device has a finer structure as a result of reducing the distance between the emitter and gate electrode, it is possible to prevent degradation of the withstand characteristics due to a decrease of the thickness of the insulating film. Additionally, the operating voltage can be lowered due to the finer structure.

In addition, a part of the insulating film (supporting the gate electrode) may be made of a material which has an etching speed different from that of the remaining portion. In this case, when a portion of the insulating film, which is close to the emitter in the gate aperture, is side-etched, the material which has a lower etching speed remains and thus has the same length as the gate electrode. Accordingly, the effective creeping distance of the insulating film in the vicinity of the emitter can be longer, thereby improving the withstand voltage with respect to the creeping surface between the emitter and gate electrode, and suppressing the generation of leak currents.

Furthermore, the insulated trench (typically, an insulating film is embedded in it) is formed in an area of substrate outside of the space around the emitter; thus, the area surrounded by the trench can function as a pinch resistor. Accordingly, the operating voltage does not increase during the normal operation, and excess current can be suppressed when a discharge occurs between the emitter and gate electrode, thereby preventing the melting destruction of the emitter or gate electrode. In addition, a part of the insulating film is present between the emitter and trench. Therefore, even if an n type diffusion layer for reducing the contact resistance is provided immediately below the emitter, the trench and the n type diffusion layer do not contact each other, and the effective width of the insulating film (in the cross direction) related to the upper portion of the trench can be greater, thereby easily suppressing the current when a discharge occurs.

In the above structure, a step of height difference may exist between the boundary and the surface on which the emitter is formed, and the portion of the step may be positioned between the insulating film and the emitter.

In addition, the insulating film supports the gate electrode, and the thickness of the insulating film is preferably greater than the distance between the emitter and the gate electrode.

Typically, the insulating film is formed on at least one of the surface of the substrate, which faces the space in which the emitter is present, and the surfaces of the gate electrode which also face the space.

It is possible that the surface of the substrate which contacts the emitter and is surrounded by the boundary has an n type area whose concentration is higher than that of the substrate.

As explained above, according to the present invention, the thickness of the insulating film which supports the gate electrode can be greater than the distance between the emitter and the gate electrode measured in the vicinity of the emitter. Therefore, the insulating capability between the emitter and the gate electrode can be improved, and the withstand voltage of a discharge-current suppressing element surrounded by the trench can be increased. Additionally, the field-emission type cold cathode with a lower operating voltage can be obtained by reducing the distance between the emitter and gate electrode.

The above field-emission type cold cathode having a high withstand voltage (with which the current can be reliably controlled when a discharge occurs), which can operate with a lower voltage, can be applied to a display device for displaying images, such as a flat panel display or a cathode ray tube. Accordingly, it is possible to provide a highly reliable display device which can operate with a lower voltage with stable current characteristics.

The above field-emission type cold cathode having a high withstand voltage (with which the current can be reliably controlled when a discharge occurs), which can operate with a lower voltage, can also be applied to a travelling-wave tube having an amplifying function by using an electron gun. Accordingly, it is possible to provide a highly reliable travelling-wave tube which can operate with a lower voltage with stable current characteristics.

DESCRIPTION OF THE PREFERRED EMBODIMENTS

Hereinafter, embodiments of the present invention will be explained with reference to the drawings.

Figure 1:
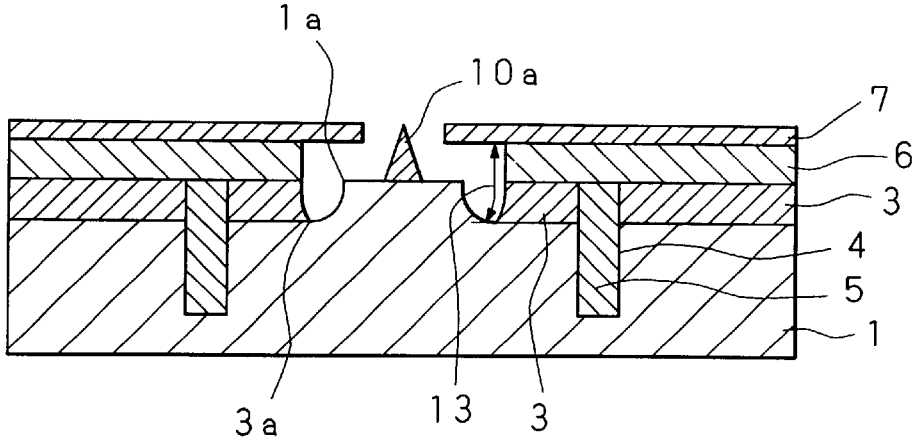
FIG. 1 is a schematic diagram showing a sectional view of the field-emission type cold cathode of the first embodiment according to the present invention.
Figure 2:
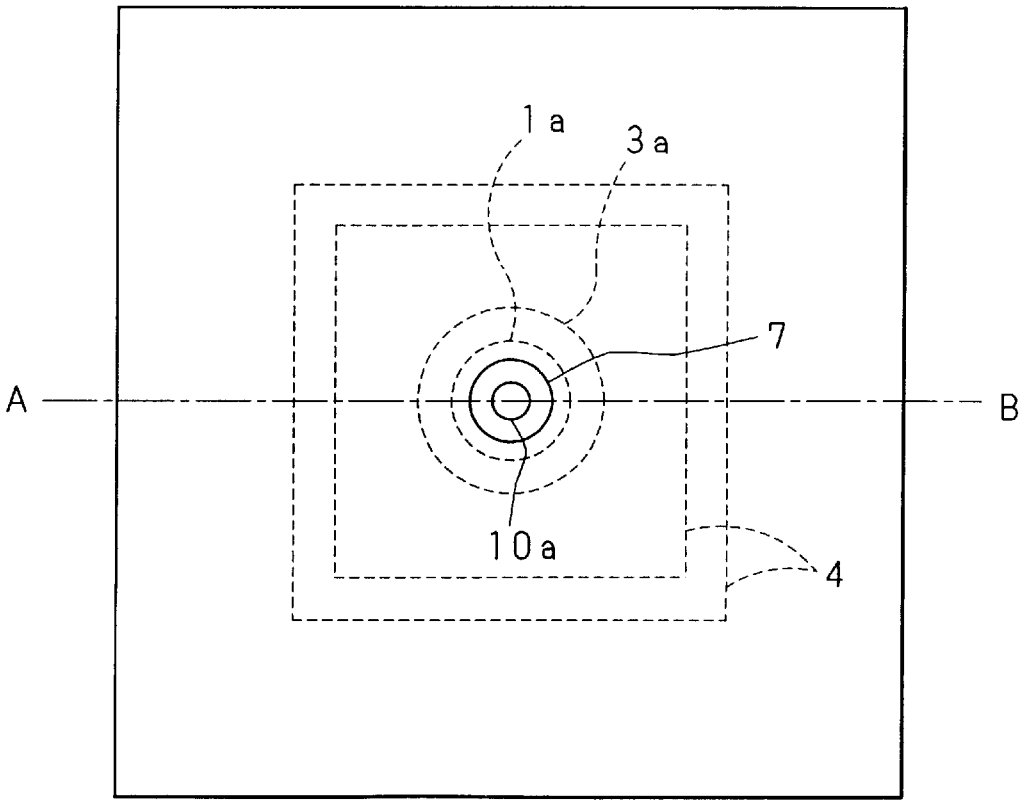
FIG. 2 is a schematic diagram showing the top view of the field-emission type cold cathode of the first embodiment.

FIG. 1 is a schematic diagram showing a sectional view (along line A–B in FIG. 2) of the field-emission type cold cathode of the first embodiment according to the present invention, while FIG. 2 is a schematic diagram showing the top view of the field-emission type cold cathode of the first embodiment. FIGS. 3A to 3E are schematic diagrams (sectional views) showing examples of processes for manufacturing the field-emission type cold cathode of the first embodiment.

In these figures, reference numeral 1 indicates a substrate, reference numeral 1*a* indicates a convex step-portion of the substrate, reference numerals 3 and 6 indicate oxide films, reference numeral 3*a* indicates an edge of the oxide film, reference numeral 4 indicates a trench formed in the substrate, reference numeral 5 indicates a BPSG (boron-phosphorus silicate glass) film embedded in the trench, reference numeral 7 indicates a gate electrode, and reference numeral 10*a* indicates an emitter. Here, the arrow indicated by reference numeral 13 shows the creeping distance, along the side faces of the oxide films, between the gate electrode and the substrate which is connected with the emitter 10*a*.

As shown in FIGS. 1 and 2, the field-emission type cold cathode of the first embodiment has (i) the n type substrate 1, the area of which is internally divided by the trench 4, and which has convex step-portion 1*a* on which sharp conical emitter 10*a* is provided, (ii) gate electrode 7 surrounding the emitter 10*a*, and (iii) oxide films 3 and 6.

The emitter 10*a* is formed on the step-portion 1*a* of the substrate, while the edge 3*a* of the oxide films 3 and 6 is provided around or outside of the step-portion 1*a* of the substrate. Accordingly, the height of the boundary between the substrate 1 and the oxide film 3, which faces the space between the gate electrode 7 and emitter electrode 10*a*, is lower than the height of the surface (of the substrate) on which the emitter is provided.

Accordingly, the total thickness of the oxide films 3 and 6 which support the gate electrode 7 can be greater than the distance between the gate electrode 7 and emitter 10*a*. In addition, trench 4 in which the BPSG film 5 is embedded is formed outside of edge 3*a* in the depth direction of the substrate. Therefore, the thickness of the insulating film between emitter 10*a* and a portion (of substrate 1) outside of trench 4 (observed from the emitter side) in the transverse direction (i.e., horizontal direction in the figure) includes (i) the width of trench 4 and (ii) the length of oxide film 3 (on the substrate) from the inner wall of trench 4 to edge 3*a*. Accordingly, the thickness of the insulating film in the transverse direction can be effectively greater by the distance from edge (or boundary) 3a to trench 4 in this embodiment.

Therefore, the withstand voltage between the gate electrode 7 and the substrate 1 which functions as the emitter electrode is mainly determined according to the withstand voltage of the oxide films 3 and 6 and the withstand voltage with respect to the discharge occurring in the gate aperture between the gate electrode 7 and emitter 10*a*. The withstand voltage between the gate electrode 7 and the substrate depends on the total film thickness of the insulating film (i.e., the total film thickness of the oxide films in this embodiment), that is, does not depend on the distance between the gate electrode 7 and emitter 10*a*. Therefore, the withstand voltage depending on the thickness of the oxide films can have a sufficient value by selecting a suitable thickness of the oxide films which satisfies the condition that the field strength in the thickness of the oxide films is smaller than a value corresponding to the destructive field.

In addition, the withstand voltage between the gate electrode 7 and emitter 10*a* is determined depending on the (amount of) current flowing due to a discharge. Here, the portion of substrate 1 surrounded by the trench 4 can function as a pinch resistor, thereby controlling the current flowing in the emitter 10*a* and preventing emitter 10*a* or gate electrode 7 from melting and breaking down when a discharge occurs. The withstand voltage of the above pinch resistor surrounded by trench 4 depends on the depth and width of the trench 4. The withstand voltage in the longitudinal direction can be improved by increasing the depth of trench 4, while the withstand voltage in the cross direction can be improved by increasing the width thereof.

In the field-emission type cold cathode, the concentration of the n type area immediately below the emitter 10*a* may be higher than that of the remaining area, so as to have a smaller contact resistance. In this case, the withstand voltage in the cross direction of the pinch resistor is determined according to the width of the upper portion of trench 4 because in the surface area immediately below the emitter, the width of the depletion layer (which spreads from the relevant side wall of the trench when a discharge occurs) is limited by the n type area. Even in this case, oxide film 3 is present between emitter 10*a* and the upper part of trench 4; thus the effective width of trench 4 on the surface area can be greater by the distance between the edge 3*a* of oxide film 3 and trench 4, thereby preventing the withstand voltage from degrading in the surface of the substrate, and obtaining a sufficient withstand voltage.

In addition, the discharge includes a creeping discharge which flows along the wall surface (exposed in the space below the gate electrode 7) of the insulating film (here, corresponding to oxide films 3 and 6) between substrate 1 (functioning as the emitter electrode) and gate electrode 1. In order to prevent generation of such a creeping discharge, the creeping distance along the insulating film between the gate electrode 7 and substrate 1, indicated by arrow 13 in FIG. 1, is greater than the distance between the emitter 10*a* and gate electrode 7, thereby preventing generation of the creeping discharge and leak current. Additionally, the area surrounded by trench 4 functions as a pinch resistor only when a discharge occurs. That is, no depletion layer spreads during the normal operation and the above area surrounded by trench 4 acts as a resistor having a low resistance so that excessive voltage increase can be prevented during normal operation.

Below, the example processes for manufacturing the field-emission type cold cathode of the first embodiment will explained with reference to FIGS. 3A to 3E.

Figure 3A:
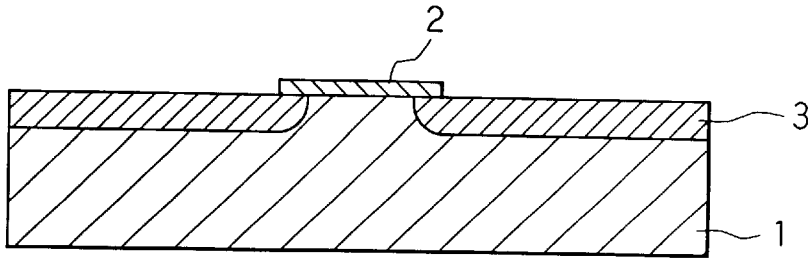
FIGS. 3A to 3E are schematic diagrams (sectional views) showing examples of processes for manufacturing the field-emission type cold cathode of the first embodiment.

First, as shown in FIG. 3A, nitride film 2 of approximately 100 nm thickness is formed using the CVD method or the like, on the surface of substrate 1 made of n type silicon of a concentration of approximately $10^{15}$ $cm^{-3}$. After this process, the patterning process is selectively performed by using the photolithography method. The thermal oxidation process is then performed on the substrate surface by using the nitride film 2 as a mask so that oxide film 3 of approximately 300 nm thickness is formed.

Figure 3B:
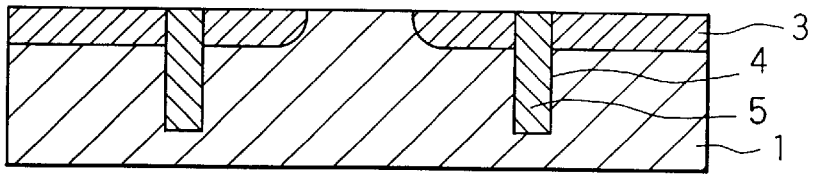

Next, as shown in FIG. 3B, an aperture (or opening) of approximately 2 $\mu$m width is formed in a predetermined area of the oxide film 3 by using a resist or the like (not shown) as a mask. The anisotropic dry etching is then performed in the exposed substrate so that trench 4 of approximately 10 $\mu$m depth is formed. After that, a BPSG film is deposited at a thickness of approximately 2 $\mu$m by using the LPCVD method, and the BPSG film is smoothed via a heat treatment at, for example, 1000° C. Then the etchback process is performed so as to remove the PBSG film portion except for the portion inside trench 4. Therefore, BPSG film 5 is embedded in trench 4 and nitride film 2 is removed.

Figure 3C:
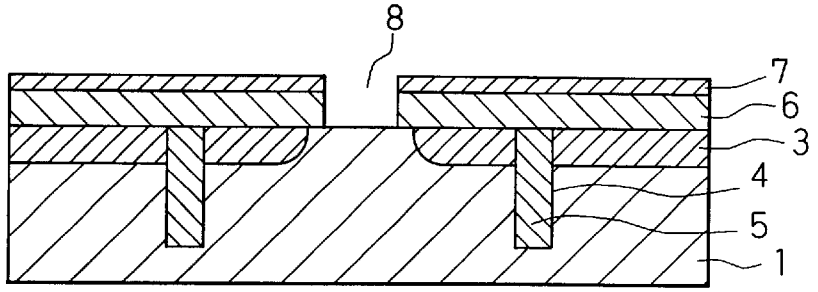

Then, as shown in FIG. 3C, oxide film 6 is deposited at a thickness of approximately 300 nm by using the CVD method. A gate-electrode film made of tungsten or the like is then deposited using the sputtering method, and the patterning for making leading (or lead) electrodes (not shown) is performed. After that, the gate-electrode film is selectively etched so that gate electrode 7 is formed. Then, a gate aperture 8 of approximately 0.6 $\mu$m diameter is provided for the gate electrode 7 and oxide film 6 by using the photolithography method.

Figure 3D:
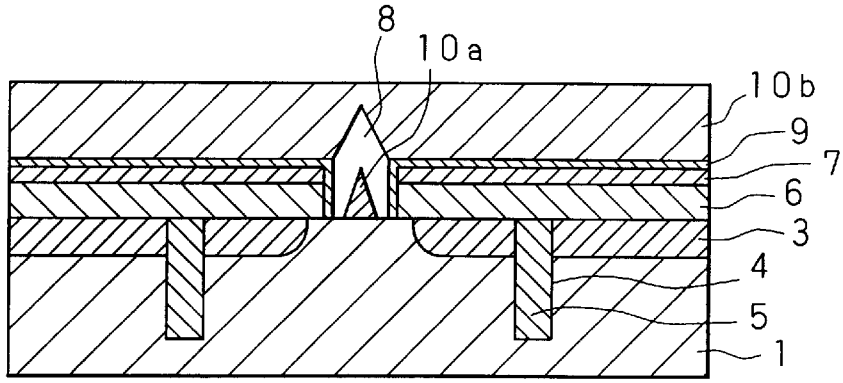

Next, as shown in FIG. 3D, sacrificial layer 9 such as an alumina film is deposited on the exposed surface of gate electrode 7 and on the exposed side wall (i.e., exposed to the gate aperture) of the oxide film 6 by performing the vapour deposition from a slantwise direction. An emitter material such as molybdenum is then deposited from a vertical direction by vapour deposition, so that a sharp conical emitter 10*a* is provided on an area (exposed in the gate aperture 8) of substrate 1, and an extra emitter material layer 10*b* is formed on the gate electrode 7.

Figure 3E:
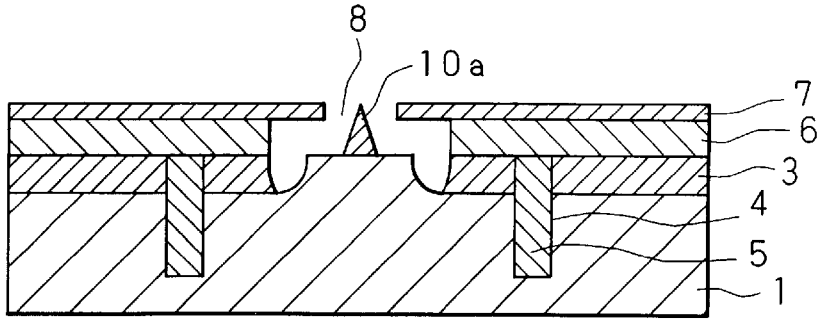

Next, as shown in FIG. 3E, the sacrificial layer 9 is etch-removed using phosphoric acid so that the extra emitter material layer 10*b* formed on the sacrificial layer 9 is lifted off and emitter 10*a* is exposed. Then, oxide film 6 exposed in the gate electrode 8 is side-etched using hydrofluoric acid, and the part of oxide film 3, which was exposed by the side etching of oxide film 6, is similarly side-etched so that the field-emission type cold cathode as shown in FIG. 3E is completed.

In this embodiment, BPSG film 5 is embedded in trench 4; however, the material embedded in the trench is not limited, for example, an oxide or nitride layer in which no impure atoms are doped may be used. In addition, the insulating film between the gate electrode 7 and the substrate is formed using oxide films 3 and 6; however, another kind of insulating film may be used if the film can be selectively side-etched.

Furthermore, in the present embodiment, oxide film 3 is formed using the thermal oxidation method; however, an oxide film may be deposited using the CVD method or the like, on a substrate surface which is in advance made lower than the (other) surface (of the substrate) on which the emitter 10*a* is formed. Here, the height of emitter 10*a* is basically determined by the width (or diameter) of gate aperture 8. Therefore, if the width of gate aperture 8 is changed, the thickness of oxide film 6 should also be changed so that the head of emitter 10*a* has approximately the same height as the head of the gate electrode 7 and that emission using the lowest gate voltage is performed. In this embodiment, the width of the gate aperture is approximately 0.6 $\mu$m, and this is an example suitable for the oxide film 6 of a thickness of approximately 300 nm. If a gate aperture having a smaller width or diameter is formed, the thickness of oxide film 6 must be smaller. In order to have a smaller diameter of the gate aperture while the thickness of the insulating film between the gate electrode 7 and substrate 1 is maintained, a thicker oxide film 3 should be provided in advance, by which the above objective can be easily achieved and it is possible to prevent the creeping distance and withstand voltage from degrading.

In addition, trench 4 provides the following advantage: even if a discharge occurs between the gate electrode 7 and emitter 10*a* and the gate electrode and emitter are in the short-circuit state, the electric potential of the substrate immediately below the emitter (at which the discharge occurred) is increased up to the electric potential of the gate electrode; thus, a potential difference between this heightened electric potential and the electric potential of the area (of substrate 1) outside of trench 4 can be approximately the same as the gate voltage, so that trench 4 can function as a gate insulating film of an FET (field effect transistor). Accordingly, a depletion layer spreads from the relevant side wall towards the center of the substrate, and thus the area surrounded by trench 4 can function as a pinch resistor, thereby suppressing currents. As a result, it is possible to prevent emitter 10*a* and gate electrode 7 from melting due to the generation of excess currents.

Below, the example processes for manufacturing the field-emission type cold cathode of the second embodiment will explained with reference to FIGS. 4A to 4E. FIGS. 4A to 4E are schematic diagrams (sectional views) showing the example processes.

Figure 4A:
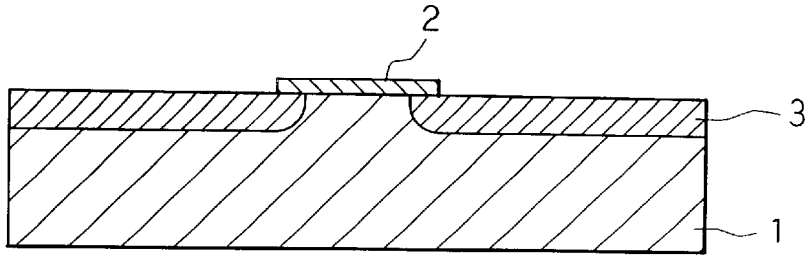
FIGS. 4A to 4E are schematic diagrams (sectional views) showing examples of processes for manufacturing the field-emission type cold cathode of the second embodiment.

First, FIG. 4A is the same as FIG. 3A. That is, FIG. 4A shows the condition that nitride film 2 is partially formed on substrate 1 of n type silicon, and then oxide film 3 is formed using the thermal oxidation process.

Figure 4B:
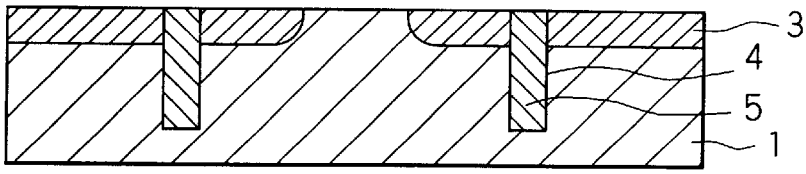

FIG. 4B is also the same as FIG. 3B. That is, FIG. 4B shows the condition that trench 4 is formed through the oxide film 3 and substrate 1, BPSG film 5 is embedded in the trench, and the nitride film 2 is removed.

Figure 4C:
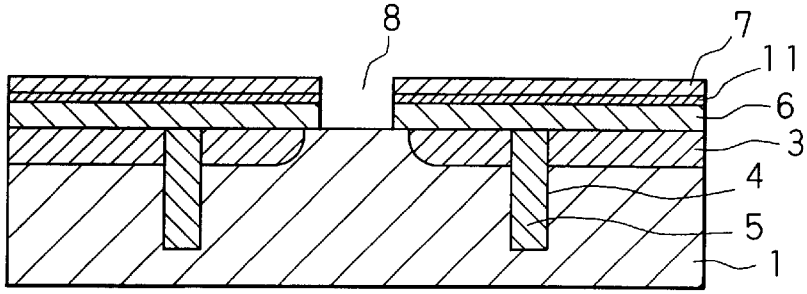

Next, as shown in FIG. 4C, oxide film 6 of approximately 200 nm thickness is deposited using the CVD method, and nitride film 11 is further deposited at a thickness of approximately 100 nm also by using the CVD method. After that, a gate-electrode film made of tungsten or the like is deposited at a thickness of approximately from 100 to 200 nm, by using the spattering method. Then, the patterning for making leading electrodes (not shown) is performed, and the gate-electrode film is selectively etched so as to form gate electrode 7. The gate aperture 8 of approximately 0.6 $\mu$m diameter is then provided in the gate electrode 7 and nitride film 11 by using the photolithography method.

Figure 4D:
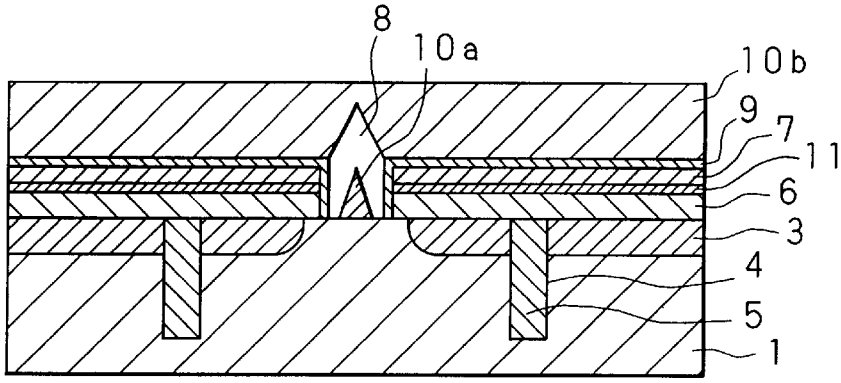

Next, as shown in FIG. 4D, a sacrificial layer 9 such as an alumina film is deposited on the exposed surface of gate electrode 7 and on the exposed side walls (exposed in the gate aperture 8) of the nitride film 11 and the oxide film 6 by performing the vapour deposition from a slantwise direction. An emitter material such as molybdenum is then deposited from a vertical direction by vapour deposition, so that sharp conical emitter 10*a* is provided on an area (exposed in the gate aperture 8) of substrate 1, and extra emitter material layer 10*b* is formed on the gate electrode 7.

Figure 4E:
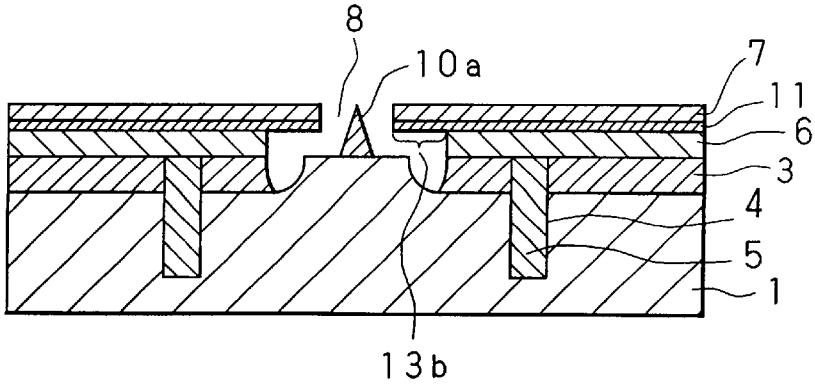

Next, as shown in FIG. 4E, the sacrificial layer 9 is etch-removed using phosphoric acid so that the extra emitter material layer 10*b* formed on the sacrificial layer 9 is lifted off and emitter 10*a* is exposed. Then, oxide film 6 exposed in the gate electrode 8 is side-etched using hydrofluoric acid, and the part of oxide film 3, which is exposed by the side etching of oxide film 6, is similarly side-etched so that the field-emission type cold cathode as shown in FIG. 4E is completed, in which the nitride film 11 remains below the electrode 7.

In this embodiment, the insulating film remaining below the gate electrode 7 is formed as nitride film 11. However, the present invention is not limited to this form, but another material may be used which has a lower etching speed when other insulating films (corresponding to oxide films 3 and 6 in this example) are side-etched.

In addition, in this embodiment, the nitride film 11 is in contact with gate electrode 7; however, the structure is not limited to such an arrangement, and the nitride film 11 may be provided in oxide film 3 or 6. In addition, multi-layered nitride films may be separately provided in the oxide films 3 and 6.

In the above first embodiment, the insulating film between the gate electrode 7 and substrate 1 is formed using a single material; however, in the second embodiment, nitride film 11 is inserted. That is, the creeping distance along the exposed part of the insulating film between the gate electrode 7 and substrate 1 is approximately the same as the thickness of the oxide films 3 and 6 in the first embodiment, but is longer by distance 13*b* (corresponding to the side-etched distance in the horizontal direction (in FIG. 4E) of oxide film 6) in the second embodiment. As a result, the withstand voltage with respect to the creeping distance can be improved, and generation of discharges and leak currents can be prevented.

Figure 5:
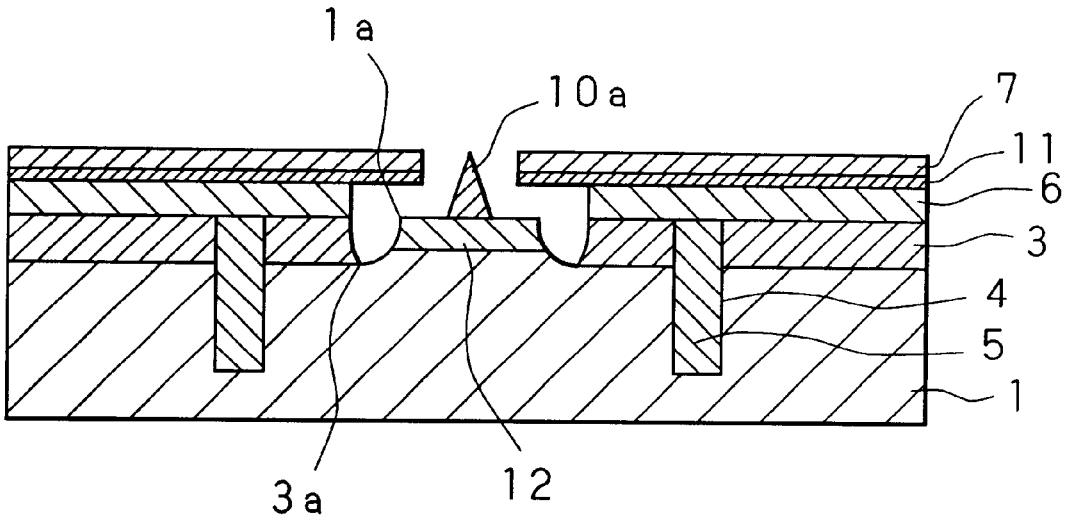
FIG. 5 is a schematic diagram showing a sectional view of the field-emission type cold cathode of the third embodiment according to the present invention.

Hereinafter, the field-emission type cold cathode as the third embodiment according to the present invention will be explained with reference to FIG. 5, which is a schematic diagram showing a sectional view of the third embodiment.

The present field-emission type cold cathode comprises (i) substrate 1 made of n type silicon, which is internally divided by trench 4 (in which BPSG film 5 is embedded) of 10 $\mu$m depth, and on which convex step-portion 1*a* and sharp conical emitter 10*a* are provided, (ii) gate electrode 7 surrounding emitter 10*a* and having a thickness of approximately from 100 to 200 nm, (iii) oxide film 3 of a thickness of 300 nm and oxide film 6 of a thickness of 200 nm, (iv) nitride film 11 of a thickness of 100 nm, and (v) n type diffusion layer 12, formed in the convex part of substrate 1, in which an impurity of a concentration of approximately $10^{17}$ $cm^{-3}$ is doped.

The emitter 10*a* is formed on the step portion 1*a* of the substrate, while the edge 3*a* of oxide films 3 and 6 is positioned outside the step portion 1*a*. That is, the height of the boundary between the oxide film 3 and substrate 1 is lower than the surface (of substrate 1) on which the emitter is provided, and oxide film 3 is provided between the n type diffusion layer 12 and trench 4. Therefore, the n type diffusion layer 12 is not in contact with trench 4, and the effective width of the trench is longer (in comparison with the conventional structure) by the distance from the edge 3*a* of the oxide film to trench 4 and operational characteristics corresponding to the effective width can be obtained. Accordingly, also in the embodiment comprising the n type diffusion layer (by which the contact resistance can be reduced), a sufficient withstand voltage can be obtained when a discharge occurs. In the present embodiment, it is unnecessary to increase the width of the trench to obtain a sufficient withstand voltage in the cross direction, and the withstand voltage can be improved; thus, it is possible to solve the conventional problem that a wider trench makes the burying process (of filling up the trench) difficult.

Figure 6:
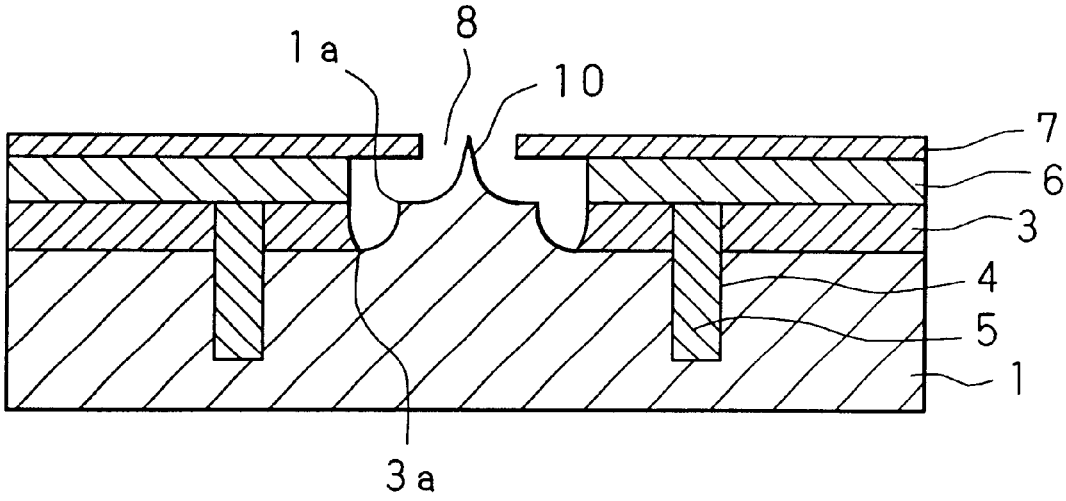
FIG. 6 is a schematic diagram showing a sectional view of the field-emission type cold cathode of the fourth embodiment according to the present invention.

Hereinafter, the field-emission type cold cathode as the fourth embodiment according to the present invention will be explained with reference to FIG. 6, which is a schematic diagram showing a sectional view of the fourth embodiment.

The present field-emission type cold cathode comprises (i) substrate 1 made of n type silicon, which is internally divided by trench 4 (in which BPSG film 5 is embedded) of 10 $\mu$m depth, and which includes convex step-portion 1*a* and sharp conical emitter 10*a* in the top-surface area, (ii) gate electrode 7 surrounding emitter 10*a* and having a thickness of approximately from 100 to 200 nm, and (iii) oxide film 3 of a thickness of 300 nm and oxide film 6 of a thickness of 300 nm.

In this structure, a part of silicon substrate 1 is processed by a known method to form a sharp conical emitter 10, and oxide film 3 is deposited on the substrate except in the vicinity of the emitter 10. After that, processes similar to those performed in the previous embodiments are performed, that is, trench 4 in which the BPSG film 5 is embedded is formed, oxide film 6 and gate electrode 7 are deposited in turn, and an aperture is provided in the gate electrode 7 above the emitter 10 by using a known etchback method. Then, oxide films 3 and 6 are side-etched using hydrofluoric acid, so that the field-emission type cold cathode as shown in FIG. 6 is completed.

The field-emission type cold cathodes in the previous embodiments have emitters which are made of molybdenum deposited on substrate 1. However, in the present embodiment, the emitter is formed by processing the substrate of n type silicon.

Figure 7:
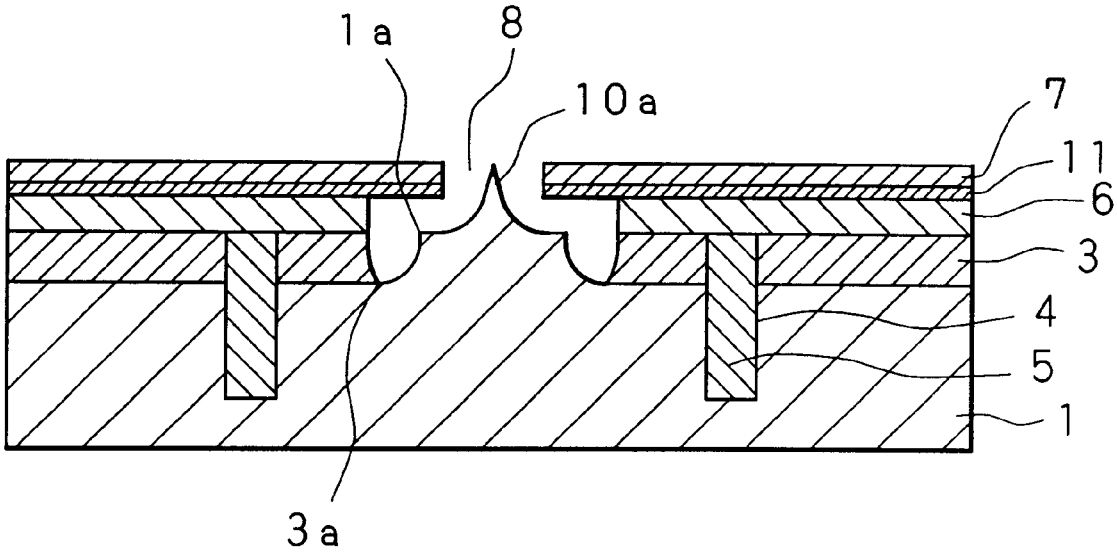
FIG. 7 is a schematic diagram showing a sectional view of the field-emission type cold cathode of the fifth embodiment according to the present invention.
Figure 8A:
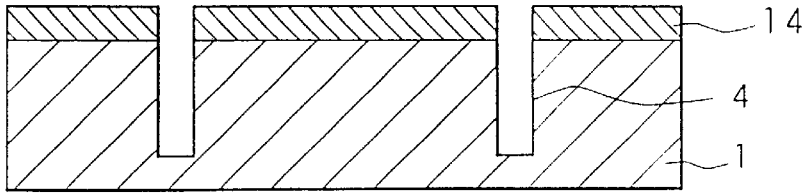
FIG. 8A PRIOR ART
FIGS. 8A to 8F are schematic diagrams (sectional views) explaining the processes for manufacturing the field-emission type cold cathode of the first conventional example.
Figure 8B:
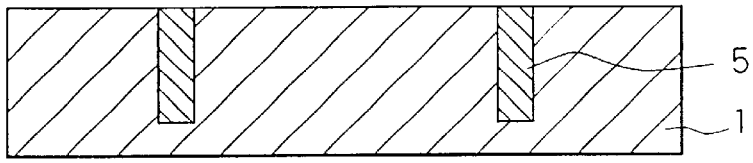
FIG. 8B PRIOR ART
Figure 8C:
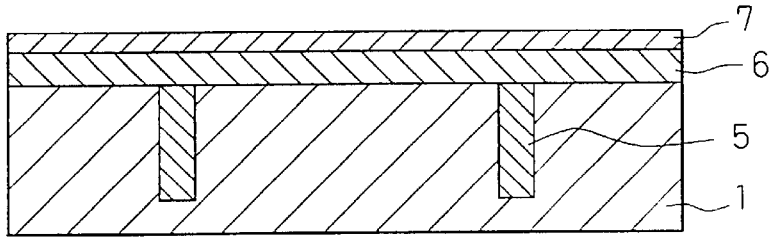
FIG. 8C PRIOR ART
Figure 8D:
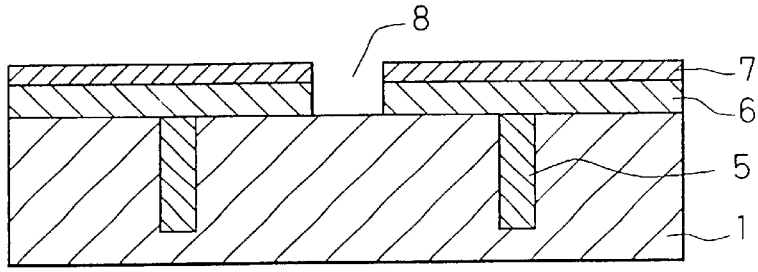
FIG. 8D PRIOR ART
Figure 8E:
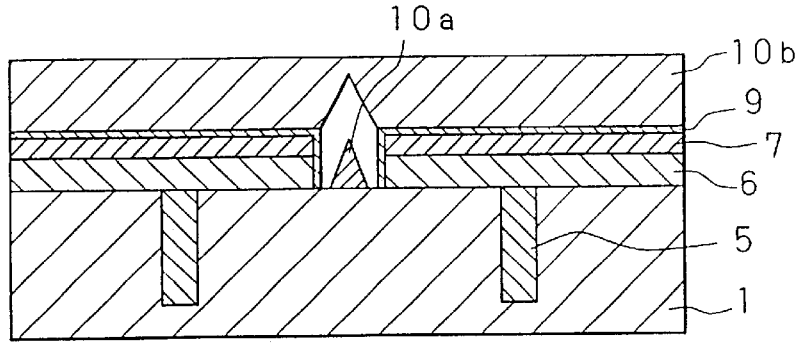
FIG. 8E PRIOR ART
Figure 8F:
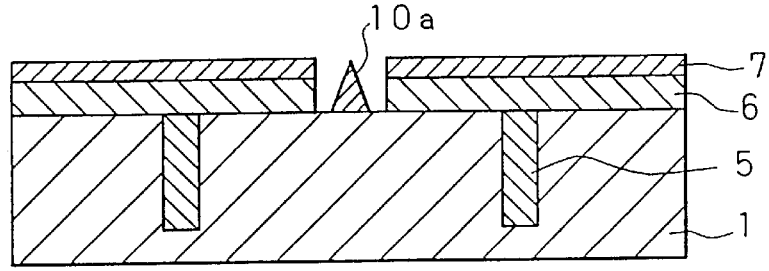
FIG. 8F PRIOR ART
Figure 9:
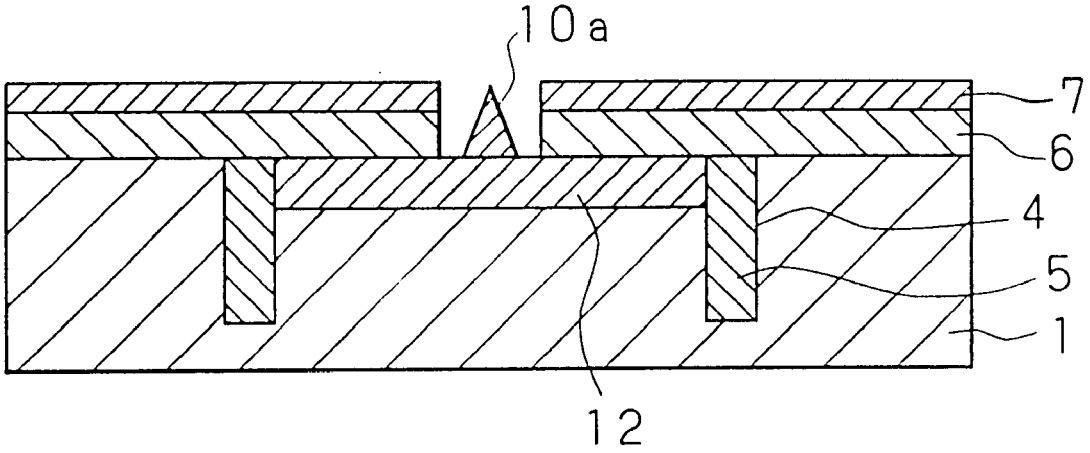
FIG. 9 PRIOR ART
FIG. 9 is a schematic diagram showing a sectional view of the field-emission type cold cathode of the second conventional example.

Hereinafter, the field-emission type cold cathode as the fifth embodiment according to the present invention will be explained with reference to FIG. 7, which is a schematic diagram showing a sectional view of the fifth embodiment.

The present field-emission type cold cathode comprises (i) substrate 1 made of n type silicon, which is internally divided by trench 4 (in which BPSG film 5 is embedded) of 10$\mu$m depth, and which includes convex step-portion 1 a and sharp conical emitter 10*a,* (ii) gate electrode 7 surrounding emitter 10*a* and having a thickness of approximately from 100 to 200 nm, (iii) oxide film 3 of a thickness of 300 nm and oxide film 6 of a thickness of 200 nm, and (iv) nitride film 11 of a thickness of approximately 100 nm.

Also in this structure, a part of silicon substrate 1 is processed by a known method to form a sharp conical emitter 10, and oxide film 3 is deposited on the substrate except in the vicinity of the emitter 10. After that, processes similar to those performed in the previous embodiments are performed, that is, trench 4 in which the BPSG film 5 is embedded is formed, oxide film 6, nitride film 11, and gate electrode 7 are deposited in turn, and an aperture is provided in the gate electrode 7 and nitride film 11 above the emitter 10 by using the known etchback method. Then, oxide films 3 and 6 are side-etched using hydrofluoric acid, so that the field-emission type cold cathode as shown in FIG. 7 is completed.

Accordingly, in the structure in which a part of silicon substrate 1 functions as the emitter, a longer creeping distance along the insulating film between the gate electrode 7 and substrate 1 can be obtained.

In the structures of the fourth and fifth embodiments, an n type diffusion layer (in which n type impurity is doped) may be provided in the portion including convex step-portion 1*a* and emitter 10.

Additionally, in the above embodiments, a single convex portion is formed on an area surrounded by trench 4 in substrate 1, and a single emitter is deposited on the convex portion or an emitter is formed by processing the substrate itself. However, the present invention is not limited to these embodiments, and (i) one or more emitters may be provided on a plurality of convex portions of the substrate, or (ii) a plurality of emitters may be provided on a convex portion which is formed on substrate 1 and is surrounded by the trench.

Furthermore, in the above embodiments, the substrate 1 has a single area surrounded by trench 4. However, the present invention is not limited to such an arrangement, and a plurality of areas (comprising convex portions), each surrounded by a trench (4), may be provided on the same substrate, and one or more emitters may be provided on each of one or more convex portions on the substrate.

If the field-emission type cold cathode according to the present invention is used as an electron gun in a display device, an anode electrode having a phosphor layer is provided at a position facing the relevant emitter, and the phosphor receives electrons (emitted from the emitter) and emits light.

Usually, when the field-emission type cold cathode of the present invention is employed as an electron gun in a display device, the cold cathode should be operated in a vacuum; thus, after the cold cathode is built in the display device, it is difficult to replace it when a problem (i.e., failure) of insulation occurs.

In addition, an electron gun operating with a lower voltage has been required so as to reduce the power consumption of the display device. In order to reduce the power consumption, it is effective to reduce the power consumption of the drive circuit for operating the electron gun. To reduce the power consumption of the drive circuit, it is effective to reduce the voltage between the emitter and the gate, that is, the driving voltage. According to the present invention, the gate diameter can be reduced while the necessary withstand characteristics with respect to the discharge or insulating destruction are maintained, thereby reducing the voltage between the emitter and gate and easily reducing the power consumption of the drive circuit. In particular, the cold cathode according to the present invention can be applied to a flat panel display having a greater number of pixels, and in this case, it is possible to operate a plurality of electron guns with low power consumption while maintaining a high operational reliability. The above effects can be obtained in other types of display devices, such as CRTs (cathode ray tube).

In addition, the field-emission type cold cathode according to the present invention may be used as an electron gun in a TWT (travelling-wave tube). Also in this case, the device is operated in a vacuum; thus, it is also difficult to replace the electron gun if insulating failure or discharge destruction occurs. In addition, if the TWT has greater power, then high electron currents are necessary; thus, to reduce the operating voltage is very important so as to reduce the power consumption. When the field-emission type cold cathode according to the present invention is applied to a TWT, a device performing highly reliable operations with a low voltage can be easily realized.

What is claimed is:

1. A field-emission type cold cathode comprising:

a substrate, on a surface of which an emitter for emitting electrons is formed, for functioning as a leading emitter electrode;

a gate electrode, formed via an insulating film on the substrate, having an aperture which surrounds the emitter via a space, and wherein the height of a boundary, facing the space, between the insulating film and the substrate is lower than the height of the surface of the substrate on which the emitter is formed, and the cold cathode further comprising:

an insulated trench surrounding an area on which the emitter is formed, where the boundary between the insulating film and the substrate is placed between the emitter and the trench, and a part of the insulating film is present between the boundary and the trench.

2. A field-emission type cold cathode as claimed in claim 1, wherein:

a step of height difference exists between the boundary and the surface on which the emitter is formed, and the portion of the step is positioned between the insulating film and the emitter.

3. A field-emission type cold cathode as claimed in claim 1, wherein:

the insulating film supports the gate electrode, and the thickness of the insulating film is greater than the distance between the emitter and the gate electrode.

4. A field-emission type cold cathode as claimed in claim 1, wherein:

the insulating film is formed on at least one of a surface of the substrate, which faces the space in which the emitter exists, and surfaces of the gate electrode which also face the space.

5. A field-emission type cold cathode as claimed in claim 1, wherein:

the surface of the substrate which contacts the emitter and is surrounded by the boundary has an n type area whose concentration is higher than that of the substrate.

6. A display device having an electron gun for displaying an image, wherein the electron gun employs a field-emission type cold cathode as claimed in any one of claims 1 to 5.

7. A display device as claimed in claim 6, wherein the display device is a flat panel display.

8. A display device as claimed in claim 6, wherein the display device is a cathode ray tube.

9. A travelling-wave tube having an amplifying function by using an electron gun, wherein the electron gun employs a field-emission type cold cathode as claimed in any one of claims 1 to 5.

* * * * *